US009393793B2

(12) United States Patent
Nakamura et al.

(10) Patent No.: US 9,393,793 B2
(45) Date of Patent: Jul. 19, 2016

(54) LIQUID EJECTING APPARATUS

(71) Applicant: SEIKO EPSON CORPORATION, Tokyo (JP)

(72) Inventors: Hiroyuki Nakamura, Shiojiri (JP); Yoshihiro Koizumi, Shiojiri (JP); Ayumi Yoshida, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/920,482

(22) Filed: Oct. 22, 2015

(65) Prior Publication Data

US 2016/0114588 A1 Apr. 28, 2016

(30) Foreign Application Priority Data

Oct. 23, 2014 (JP) ..... 2014-216238
Oct. 27, 2014 (JP) ..... 2014-218051

(51) Int. Cl.
*B41J 2/15* (2006.01)
*B41J 2/175* (2006.01)

(52) U.S. Cl.
CPC ..... *B41J 2/175* (2013.01)

(58) Field of Classification Search
CPC ..... B41J 2/175; B41J 2/01; B41J 2/16526; B41J 2/03; B41J 2/18
See application file for complete search history.

(56) References Cited

U.S. PATENT DOCUMENTS 8,540,352 B2 * 9/2013 Igarashi ..... B41J 2/17596 347/84
8,851,643 B2 * 10/2014 Tsubaki ..... B41J 2/175 347/84
2009/0153629 A1 6/2009 Yokouchi
2009/0179974 A1 7/2009 Kimura
2012/0127244 A1 5/2012 Suzuki

FOREIGN PATENT DOCUMENTS

JP 2005-096152 A 4/2005
JP 2009-166473 A 7/2009
JP 2009-172856 A 8/2009
JP 2012-111096 A 6/2012

* cited by examiner

*Primary Examiner* — Lamson Nguyen
(74) *Attorney, Agent, or Firm* — Workman Nydegger

(57) ABSTRACT

Provided is a liquid ejecting apparatus including: a liquid ejecting head that ejects a liquid which is supplied from a liquid accommodation body that accommodates the liquid; a liquid supply passage that connects between the liquid accommodation body, and the liquid ejecting head; multiple sub-tanks, each of which stores the liquid within the ink supply passage and changes spatial capacity for storing the liquid by a displacement of a flexible member; and a pressurization mechanism that applies a different pressure to each of flexible members of the multiple sub-tanks.

16 Claims, 10 Drawing Sheets

LIQUID EJECTING APPARATUS

BACKGROUND

1. Technical Field

The present invention relates to a liquid ejecting apparatus.

2. Related Art

In the related art, an ink jet type recording apparatus is known as one of liquid ejecting apparatuses that eject liquid onto a target from a nozzle. The ink jet type recording apparatus includes a recording head that ejects ink, and while moving a recording head relative to a recording medium, ejects the ink from a nozzle that is formed in the recording head and performs printing on the recording medium (refer to JP-A-2005-96152).

JP-A-2005-96152 discloses an ink jet printer in which two sub-tanks, each of which has a different size and in each of which ink can be stored, are provided in an ink supply passage between an ink tank and a recording head in such a manner that it is possible to replace the ink tank without interrupting recording performed by a recording head. The two sub-tanks have different sizes, and the smaller of the two sub-tanks is arranged upstream.

Because the smaller-sized sub-tank is linked to the larger-sized sub-tank, in a case where a smaller-sized sub-tank on the upstream side is full of ink, it is understood that a larger-sized sub-tank on the downstream side is also full of ink. Furthermore, in a case where the smaller-sized sub-tank on the upstream side is not full of ink, it can be determined that the ink tank has run out of ink. For this reason, a displacement sensor is provided in the smaller-sized sub-tank, and a near ink end is detected and thus an instruction to replace the ink tank may be provided. While an ink tank is replaced, the printing that uses the larger-sized sub-tank on the downstream side continues.

Incidentally, in order to determine whether or not the sub-tank is full of ink, there is a need to detect displacement of a flexible member that is provided in the sub-tank and that is deformed in a concave shape according to an amount of negative pressure. However, because the displacement of the flexible member is greatly influenced by deformation characteristics of a material of the flexible member, variation in the displacement is great. For example, there is a case where, with a configuration in the related art, the displacement of the larger-sized sub-tank is detected earlier than the displacement of the smaller-sized sub-tank.

SUMMARY

An advantage of some aspects of the invention is to provide a liquid ejecting apparatus that is capable of preventing a job from being interrupted due to running out of ink.

According to an aspect of the invention, there is provided a liquid ejecting apparatus including a liquid ejecting head that ejects a liquid which is supplied from a liquid accommodation body that accommodates the liquid, a liquid supply passage that connects between the liquid accommodation body, and the liquid ejecting head, multiple sub-tanks, each of which has spatial capacity, which changes, for storing the liquid within the ink supply passage and for storing the liquid with displacement of a flexible member, and a pressurization unit that applies a different pressure to each of flexible members of the multiple sub-tanks.

By employing this configuration, according to the invention, a pressurization unit is provided, and a different pressure is applied to each of the flexible members of the multiple sub-tanks. In this manner, by actively applying a pressure to the flexible members of the multiple sub-tanks from the outside, an influence of deformation characteristics of the flexible member can be decreased, and the multiple sub-tanks can be deformed at different times. For this reason, variation in the displacement of each of the multiple sub-tanks is suppressed, and thus a change over time in a state of a pressure within the liquid supply passage can be reliably observed, and a timing for replacement of the liquid accommodation body can be recognized.

In the liquid ejecting apparatus according to the aspect of the invention, the pressurization unit may include multiple urging members that urge the flexible members of the multiple sub-tanks, respectively, and the multiple urging members differ in at least one among a spring constant, a stroke that displaces the flexible member all the way to a button dead point, and a pressurization area with which the flexible member is pressurized.

By employing this configuration, according to the invention, the multiple urging members apply a different pressure to each of the flexible members of the multiple sub-tanks. The urging member can simply adjust the pressure that is applied to each of the flexible members of the multiple sub-tanks by differentiating between at least ones of the spring constants, the strokes that displace the flexible members all the way to the bottom dead point, and the pressurization areas with which the flexible members are pressurized.

In the liquid ejecting apparatus according to the aspect of the invention, the pressurization unit may include a pressure-bearing member in the shape of a plate that adjusts the pressurization area with which the urging member pressurizes the flexible member.

By employing this configuration, according to the invention, a pressure-bearing member in the shape of a plate is provided, and the pressurization area with which the urging member pressurizes the flexible member is adjusted. Because the pressurization area of the urging member with respect to the flexible member can be kept constant by providing the pressure-bearing member in the shape of a plate, the influence of the deformation characteristics of the flexible member is decreased, and the multiple sub-tanks can be reliably deformed at different times.

In the liquid ejecting apparatus according to the aspect of the invention, the pressurization unit may increase a pressure that is applied to a flexible member of a sub-tank that is positioned furthest upstream, among the multiple sub-tanks, to the maximum, and may decrease a pressure that is applied to a flexible member of a sub-tank that is positioned further downstream than the sub-tank, in the downstream direction.

By employing this configuration, according to the invention, because the multiple sub-tanks are deformed at different times, starting with the sub-tank on the upstream side, the change over time in the state of the pressure within the liquid supply passage can be observed more reliably, and the timing for the replacement of the liquid accommodation body can be recognized. Furthermore, with this configuration, because among the multiple sub-tanks, the sub-tank that is positioned furthest downstream is displaced last, the pressure loss that results when the liquid is ejected from the liquid ejecting head can be minimized as the ink end is approached.

In the liquid ejecting apparatus according to the aspect of the invention, a displacement sensor that detects displacement of the flexible member may be provided in at least one among the multiple sub-tanks.

By employing this configuration, according to the invention, the displacement sensor is provided in at least one among the multiple sub-tanks, and the displacement of the flexible member is detected. Thus, the timing for the replacement of the liquid accommodation body can be easily recognized. Furthermore, because the order in which the multiple sub-tanks are deformed can be recognized by the pressure adjustment by the pressurization unit, if the displacement sensor is provided in at least one of the multiple sub-tanks, the change over time in the state of the pressure within the ink supply passage can be observed.

In the liquid ejecting apparatus according to the aspect of the invention, among the multiple sub-tanks, the displacement sensor may be provided in the sub-tank that is positioned at least furthest upstream.

By employing this configuration, according to the invention, the displacement sensor is provided in the sub-tank on the furthest upstream side among the multiple sub-tanks, and the replacement of the flexible member that has the highest responsiveness to an amount of remaining liquid that is nearest the liquid accommodation body is detected. Accordingly, the amounts of remaining liquid within the liquid accommodation body can be measured with high accuracy, and a job that is currently being executed can be continued using liquid that is stored in the sub-tank on the downstream side, which has a small pressure loss.

In the liquid ejecting apparatus according to the aspect of the invention, an inlet port through which the liquid is introduced may be provided in a lower portion of each of the multiple sub-tanks and an outlet port through which the liquid is discharged may be provided in an upper portion of each of the multiple sub-tanks, and the inlet port and the outlet port are open horizontally in the same direction.

By employing this configuration, according to the invention, the inlet port of the sub-tank is provided in the lower portion, the outlet port of the sub-tank is provided in the upper portion, and the inlet port and the outlet port are open in the same horizontal direction. Thus, the liquid that is introduced from the inlet port into the sub-tank flows from the lower portion of the sub-tank along an internal wall and is discharged from the outlet port through the upper portion. For this reason, sedimentary components of liquid that precipitate in the lower portion of the sub-tank can be agitated and the extent to which air bubbles accumulated in the upper portion of the sub-tank are discharged can be improved.

In the liquid ejecting apparatus according to the aspect of the invention, the multiple sub-tanks, starting with a sub-tank that is positioned furthest upstream and ending with a sub-tank that is positioned furthest downstream, may be arranged in order in portions of the ink supply passage, starting with the lowermost portion and ending with the uppermost portion in the gravitational direction.

By employing this configuration, according to the invention, the multiple sub-tanks are arranged side by side in the gravitational direction in such a manner that the upstream side is positioned in the lower portion and the downstream side is positioned in the upper portion. Accordingly, because with a buoyant force, air bubbles can easily pass through the sub-tank on the downstream side and be easily discharged from the liquid ejecting head, the extent to which the air bubbles are discharged can be improved.

In the liquid ejecting apparatus according to the aspect of the invention, a one-way valve that allows only flowing of liquid toward the downstream side may be provided in the liquid supply passage on the side further upstream than the multiple sub-tanks, and a self-sealing valve that opens the liquid supply passage when the downstream side is under predetermined negative pressure may be provided in the liquid supply passage on the side further downstream than the multiple sub-tanks.

By employing this configuration, according to the invention, a one-way valve is provided on the side further upstream than the multiple sub-tanks, and thus the reverse flow of the liquid to the liquid accommodation body can be prevented. Furthermore, the self-sealing valve is provided on the side further downstream than the multiple sub-tanks, and thus the leakage of the liquid from the liquid ejecting head can be reliably prevented.

The liquid ejecting apparatus according to the aspect of the invention further includes a pressurization unit that pressurizes the liquid accommodation body.

By employing this configuration, according to the invention, the pressurization unit is provided, and the liquid accommodation body is pressurized. Thus, a supply pressure at which the liquid is supplied to the liquid ejecting head through the liquid supply passage can be increased, and high-speed printing is possible with the ink jet head.

In the liquid ejecting apparatus according to the aspect of the invention, among pressures that the pressurization unit applies, the smallest pressure may be greater than a supply pressure necessary for the liquid ejecting head to eject the liquid.

By employing this configuration, according to the invention, even if an amount of remaining liquid within the liquid accommodation body is low, with the pressure that is applied to the sub-tank, the liquid can be ejected from the liquid ejecting head. For this reason, it is possible to stably supply the liquid until the liquid within the sub-tank is used up.

According to another aspect of the invention, there is provided a liquid ejecting apparatus including a liquid ejecting head that ejects liquid that is supplied from a liquid-accommodation body that accommodate the liquid, a liquid supply passage that connects between the liquid accommodation body and the liquid ejection head, a pressurization device that pressurizes the liquid supply passage, a sub-tank that stores the liquid within the liquid supply passage, and a one-way valve that allows only flowing of liquid toward the downstream side within the liquid supply passage on the upstream side further upstream than the sub-tank. The sub-tank includes a urging member which has spatial capacity for at least accommodating an amount of liquid that results from integrating a maximum amount of flowing liquid per unit hour, which is able to be ejected by the liquid ejecting head, over at least a part of the time that it takes for the liquid supply passage to reach a predetermined pressure by virtue of a pressure exerted by the pressurization device, pressurizes the sub-tank in the direction of reducing the spatial capacity for the at least a part of the time, and causes the liquid to be able to be ejected from the liquid ejecting head.

By employing this configuration, according to the invention, because it is possible for the spatial capacity of the sub-tank to at least accommodate an amount of liquid that results from integrating a maximum amount of flowing liquid per unit hour, which is able to be ejected by the liquid ejecting head over at least a part of the time that it takes for the liquid supply passage to reach a predetermined pressure by virtue of the pressure exerted by the pressurization device, it is possible for the sub-tank to accommodate an amount of liquid that is to be ejected from the liquid ejecting head while the pressurization by the pressurization device is in progress. Furthermore, according to the invention, for at least a part of the time, by applying the pressure in the direction of decreasing the spatial capacity of the sub-tank, a liquid supply pressure sufficient to eject the liquid from the liquid ejecting head is secured while the pressurization by the pressurization device is in progress, and it is possible to eject the liquid from the liquid ejecting head. Therefore, according to the invention, high-speed printing can be performed immediately after power is supplied without the need to wait until the pressurization device rises completely.

In the liquid ejecting apparatus according to the aspect of the invention, when a pressure exerted by the urging member is set to Ps, a pressure within the liquid accommodation body, which is generated by the pressurization device is set to Pi, a pressure necessary for the liquid ejecting head to eject the liquid is set to Ph, a pressure loss within the liquid supply passage between the liquid accommodation body and the sub-tank is set to ΔPis, and a pressure loss within the liquid supply passage between the sub-tank and the liquid ejecting head is set to ΔPsh, a relationship expressed by $(Pi-\Delta Pis) > Ps > (Ph+\Delta Psh)$ may be established.

By employing this configuration, according to the invention, because the pressure exerted by the urging member is greater than a sum of the pressure necessary for the liquid ejecting head to eject the liquid and the pressure loss occurring in the liquid supply passage on the side further downstream than the sub-tank, even if the pressurization device does not rise, a sufficient ink supply pressure to the liquid ejecting head can be secured. Furthermore, because the pressure exerted by the urging member is smaller than a difference between the pressure within the liquid accommodation body, which is generated by the pressurization device and the pressure loss that occurs in the liquid supply passage on the side further upstream than the sub-tank, liquid that flows from the upstream side of the liquid supply passage to the downstream side can be used without the urging member preventing the pressurization device from supplying the liquid. Furthermore, the liquid within the liquid accommodation body can be used to the end, and it is possible to reduce an amount of remaining liquid.

In the liquid ejecting apparatus according to the aspect of the invention, a displacement sensor that detects displacement of the spatial capacity may be provided in the sub-tank.

By employing this configuration, according to the invention, the displacement sensor is provided, and the displacement of the sub-tank is detected. Thus, the timing for the replacement of the liquid accommodation body can be easily recognized. Furthermore, it is easy to determine to what extent printing or cleaning is possible after the detection of the spatial capacity of the sub-tank.

In the liquid ejecting apparatus according to the aspect of the invention, the multiple sub-tanks may be provided in series in the liquid supply passage, and the displacement sensor may be provided in a sub-tank that is furthest upstream, among the multiple sub-tanks.

By employing this configuration according to the invention, the displacement sensor is provided in the sub-tank on the furthest upstream side among the multiple sub-tanks that are arranged side by side in series, and detects the displacement of the sub-tank that has high responsiveness to an amount of remaining liquid that is nearest the liquid accommodation body. Accordingly, the amount of remaining ink within the liquid accommodation body can be measured with high accuracy, and after the detection, a job that is currently being executed can be continued using liquid that is stored in the sub-tank on the downstream side, which has a small pressure loss.

In the liquid ejecting apparatus according to the aspect of the invention, the multiple sub-tanks may be provided in parallel in the liquid supply passage, and the displacement sensor may be provided in any one among the multiple sub-tanks.

By employing this configuration, according to the invention, the displacement sensor may be provided in any one among the multiple sub-tanks that are arranged side by side in parallel, and recognizes an amount of remaining liquid within the liquid accommodation body. By arranging the multiple sub-tanks in parallel, the pressure loss within the sub-tanks, which occurs in the in-series arrangement, can be made not to occur.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
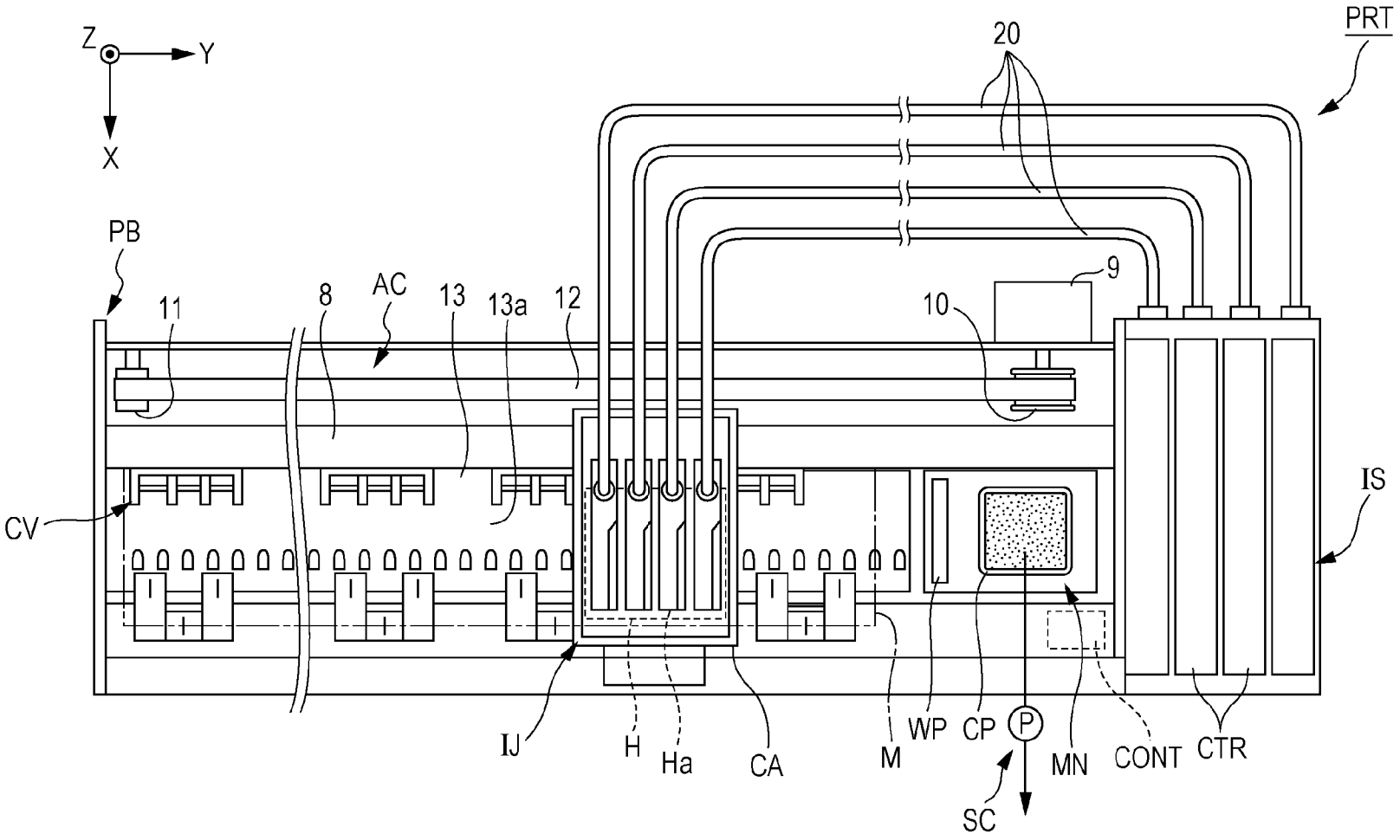
FIG. 1 is a top view illustrating a printer according to an embodiment of the invention.

A liquid ejecting apparatus according to each embodiment of the invention will be described below referring to the drawings. Moreover, in each of the drawings, which are below referred to in the following description, in order for each member to have a recognizable size, a scale of each member is appropriately changed. As the liquid ejecting apparatus according to the embodiment of the invention, an ink jet type printer (hereinafter referred to as a printer) will be illustrated.

FIG. 1 is a top view illustrating a printer PRT according to the embodiment of the invention.

The printer PRT that is illustrated in FIG. 1 is an apparatus that performs printing processing while transporting a recording medium M in the shape of a sheet, such as a plastic sheet. The printer PRT includes a housing PB, an ink jet mechanism IJ that ejects the ink onto the recording medium M, an ink supply mechanism IS that supplies the ink to the ink jet mechanism IJ, a transportation mechanism CV that transports the recording medium M, a maintenance mechanism MN that performs an operation of maintaining the ink jet mechanism IJ, and a controller CONT that controls these mechanisms.

Hereinafter, an XYZ rectangular coordinate system is set, and a positional relationship between constituent elements is described while appropriately referring to the XYZ rectangular coordinate system. According to the present embodiment, a direction of transportation of the recording medium M is set to be an X-axis direction, a direction that orthogonally intersects the X-axis direction on a transportation surface of the recording medium M is set to be an Y-axis direction, and a direction that is perpendicular to a plane that includes an X-axis and a Y-axis is expressed as a Z-axis direction.

The housing PB is formed in such a manner that the longest side of the housing PB has the Y-axis direction. Each portion of the ink jet mechanism IJ, the ink supply mechanism IS, the transportation mechanism CV, the maintenance mechanism MN and the controller CONT is attached to the housing PB. A platen 13 is provided in the housing PB. The platen 13 is a support member that supports the recording medium M. The platen 13 is arranged in the center portion in the X direction, of the housing PB. The platen 13 has a flat surface 13*a* that faces the positive Z side. The flat surface 13*a* is used as a support surface that supports the recording medium M.

The transportation mechanism CV has a transportation roller, and a motor or the like (both are not illustrated) that drives the transportation roller. The transportation mechanism CV transports the recording medium M from the negative X side of the housing PB to within the housing PB, and discharges the recording medium M from the positive X side of the housing PB to the outside of the housing PB. Within the housing PB, the transportation mechanism CV transports the recording medium M in such a manner that the recording medium M passes over the platen 13. For the transportation mechanism CV, a transportation timing, an amount of transportation, and the like are controlled by the controller CONT.

The ink jet mechanism IJ has an ink jet head H (a liquid ejecting head) through which to eject ink (liquid), and a head moving mechanism AC that moves the ink jet head H in a state of holding the ink jet head H. The ink jet head H ejects ink toward the recording medium M sent out over the platen 13. The ink jet head H has an ejection surface Ha on which a nozzle through which to eject ink is formed. The ejection surface Ha is directed toward the Z-axis direction and is arranged in such a manner as to face a support surface of the platen 13.

The head moving mechanism AC has a carriage CA. The ink jet head H is fixed to the carriage CA. The carriage CA is configured in such a manner that the carriage CA freely moves along a guide shaft 8 that is constructed in the lengthwise direction (the Y-axis direction) of the housing PB. The ink jet head H and the carriage CA are arranged on the positive Z side with respect to the platen 13.

In addition to the carriage CA, the head moving mechanism AC has a pulse motor 9, a drive pulley 10 that is driven rotatianlly by the pulse motor 9, a driven pulley 11 that is provided on the opposite side (the negative Y side) to the side (the positive Y side) on which the drive pulley 10 is provided in the lengthwise direction of the housing PB, and a timing belt 12 that is hung between the drive pulley 10 and the driven pulley 11.

The carriage CA is connected to the timing belt 12. The carriage CA is provided in such a manner that the carriage CA is movable in the Y-axis direction according to rotation of the timing belt 12. When moving in the Y-axis direction, the carriage CA is guided by the guide shaft 8.

The maintenance mechanism MN is arranged in a home position of the ink jet head H. The home position is set to be in an area that is separate from an area at which printing is performed on the recording medium M. According to the present embodiment, the home position is set to be on the positive Y side of the platen 13. The home position is a place where the ink jet head H waits when the printer PRT is powered off, recording is not performed over a long period of time, or the like.

The maintenance mechanism MN has a cap member CP that covers a nozzle of the ink jet head H, a wiping member WP that wipes the ejection surface Ha, or the like. A suction device SC such as a suction pump is connected to the cap member CP. The cap member CP can suck ink from the ink jet head H with the suction device SC.

The ink supply mechanism IS supplies ink to the ink jet head H. The ink supply mechanism IS has multiple ink cartridges CTR (liquid accommodation bodies). The printer PRT according to the present embodiment employs a configuration (an off carriage type) in which, unlike the ink jet head H, the ink cartridge CTR is not mounted on the carriage CA.

Figure 2:
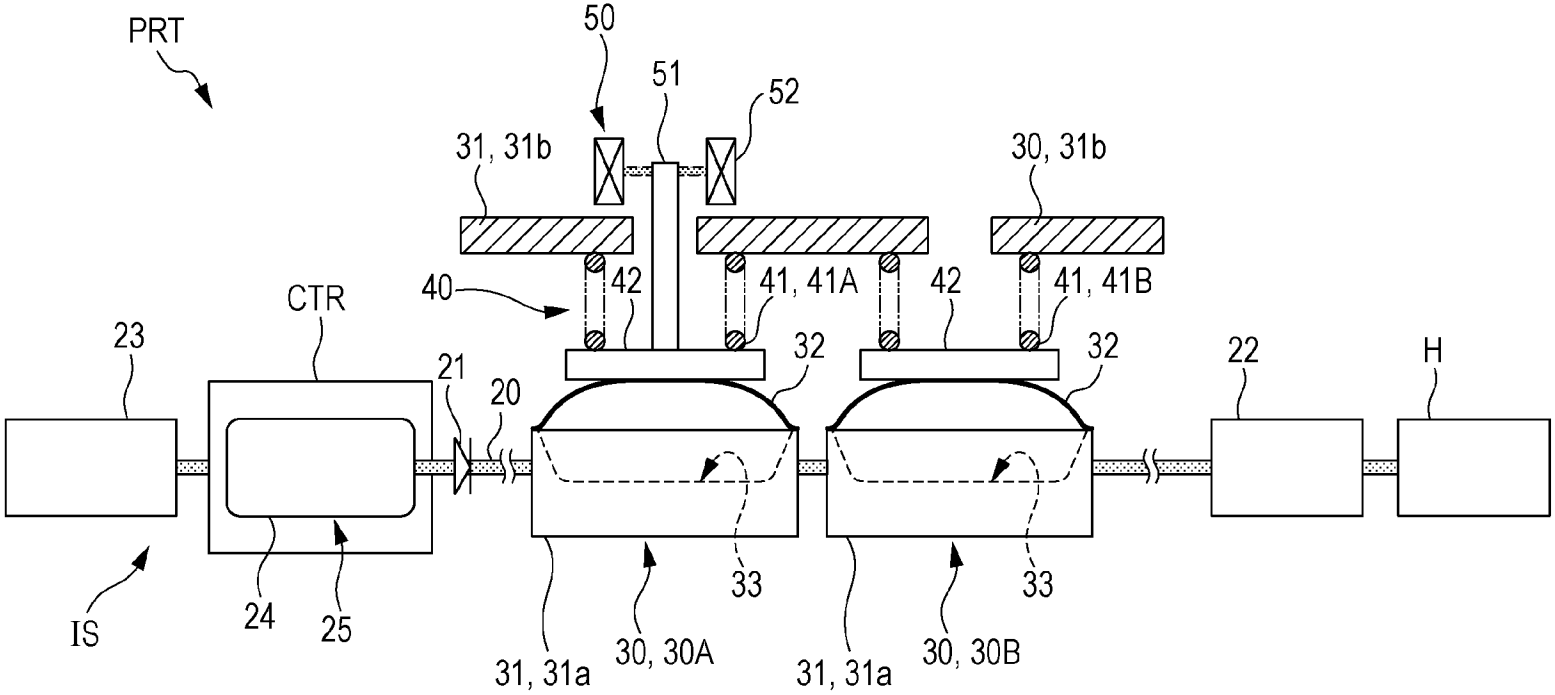
FIG. 2 is a schematic diagram illustrating an ink supply system of the printer according to the embodiment of the invention.

FIG. 2 is a schematic diagram illustrating an ink supply system of the printer PRT according to the embodiment of the invention.

The ink supply mechanism IS has an ink supply passage (a liquid supply passage) 20 that connects between the ink cartridge CTR and the ink jet head H. A check valve 21 (a one-way valve), multiple sub-tanks 30, and a self-sealing valve 22 are provided in the ink supply passage 20. Moreover, an ink supply passage 20 is provided in each of the multiple ink cartridges CTR (refer to FIG. 1).

The check valve 21 is provided in a portion of the ink supply passage 20 further upstream than are the multiple sub-tanks 30. That is, the check valve 21 is positioned further upstream than is a first sub-tank 30A that, among the multiple sub-tanks 30, is positioned the furthest upstream, and is provided in a portion of the ink supply passage 20 further downstream than is the ink cartridge CTR. The check valve 21 is a valve that allows flowing of ink from the ink cartridge CTR downward to the ink jet head H. The reverse flow of the ink to the ink cartridge CTR can be prevented by the check valve 21.

The self-sealing valve 22 is provided in a portion of the ink supply passage 20 further downstream than are the multiple sub-tanks 30. That is, the self-sealing valve 22 is positioned further downstream than is a second sub-tank 30B that, among the multiple sub-tanks 30, is positioned furthest downstream, and is provided in a portion of the ink supply passage 20 further upstream than is the ink jet head H. The self-sealing valve 22 is a valve that opens the ink supply passage 20 when the downstream side to which the ink jet head H is provided is under a predetermined negative pressure. The self-sealing valve 22 prevents the oversupply of ink and can reliably prevent the leakage of ink from the ink jet head H.

Because a configuration of the self-sealing valve 22 is publicly known, a detailed description thereof is omitted, but the self-sealing valve 22 has a valve (not illustrated) which opens and closes the ink supply passage 20, a urging member (not illustrated) that applies a force in the direction of closing the valve, and a flexible member (not illustrated) that, for opening, pushes the valve against the urging by the urging member when the ink supply passage 20 is under negative pressure. That is, with a difference between a pressure within the ink supply passage 20 and the atmospheric pressure, the self-sealing valve 22 opens the ink supply passage 20. The ink jet head H can eject the ink normally by securing a predetermined level of an ink supply pressure in the self-sealing valve 22 or higher.

The ink cartridge CTR is connected to a pressurization pump (a pressure unit) 23. The pressurization pump 23 pressurizes a pressurization compartment 25 that accommodates an ink pack 24 of the ink cartridge CTR. When the pressurization pump 23 is driven, air is sent into the pressurization compartment 25 and thus the ink pack 24 is pressurized.

When the ink pack 24 is pressurized, an ink supply pressure within the ink supply passage 20 is increased and for example, high-speed printing is possible with the ink jet head H. Moreover, regarding the pressure within the ink supply passage 20, due to a pressure loss within a channel, the pressure on the ink cartridge CTR side (the upstream side) is increased, and the ink jet head H side (the downstream side) is decreased.

The ink within the ink supply passage 20 is stored in the sub-tank 30, and a spatial capacity for storing the ink is changed due to displacement of a flexible member 32. The multiple sub-tanks 30 may be provided in the ink supply passage 20, but according to the present embodiment, two sub-tanks, that is, the first sub-tank 30A and the second sub-tank 30B, are provided in series. The sub-tank 30 is configured in such a manner that the flexible member 32 is laminated on a housing 31, and the spatial capacity of an ink compartment 33 that is formed inside varies according to an amount of remaining ink. The flexible member 32 is formed of a single layer or multiple layers of flexible resin film (for example, PET/CPP laminated film or the like).

Next, a configuration and arrangement of the sub-tank 30 will be described in detail below referring to FIGS. 3 to 7.

Figure 3:
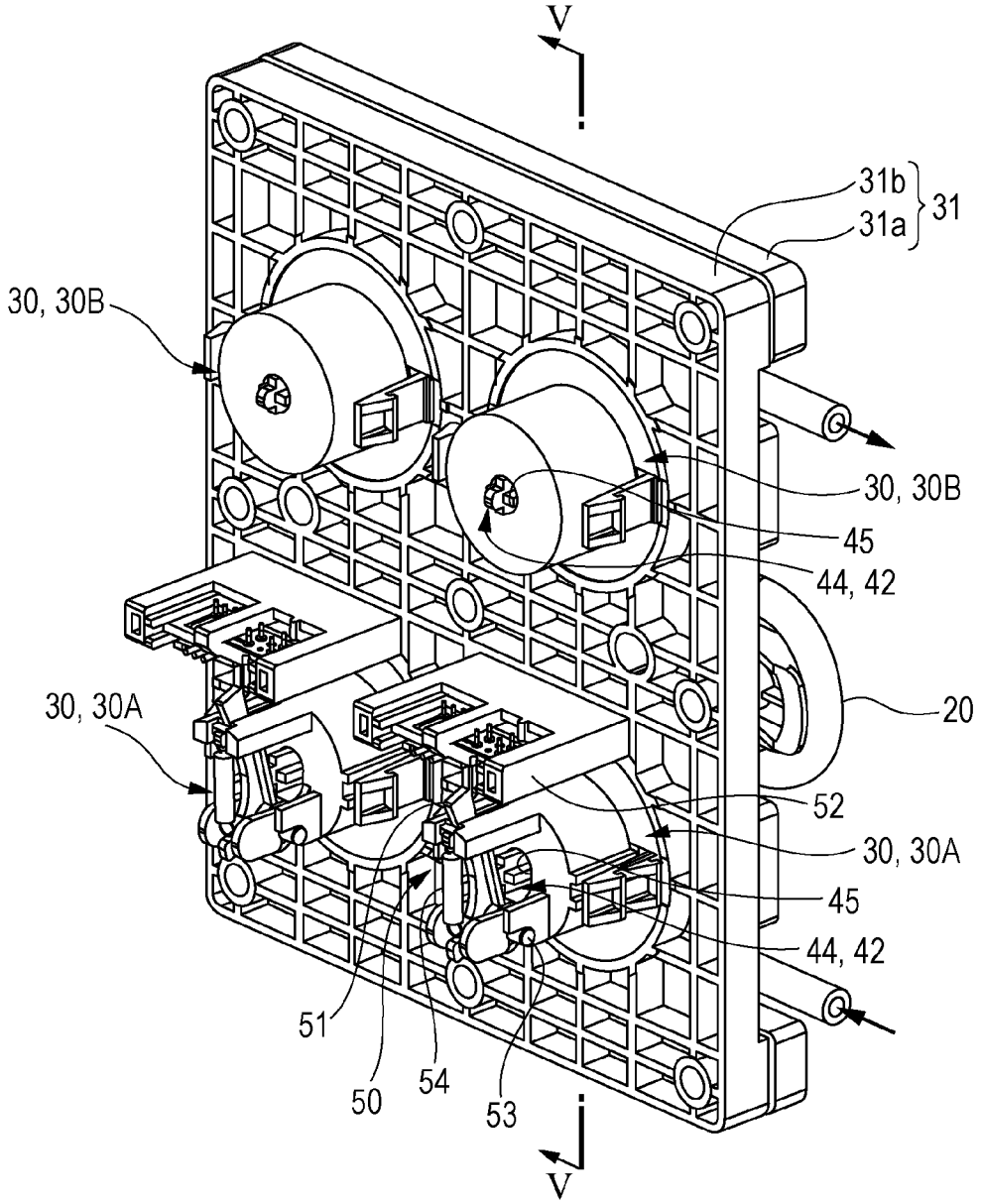
FIG. 3 is a front perspective view of a sub-tank according to the embodiment of the invention.
Figure 4:
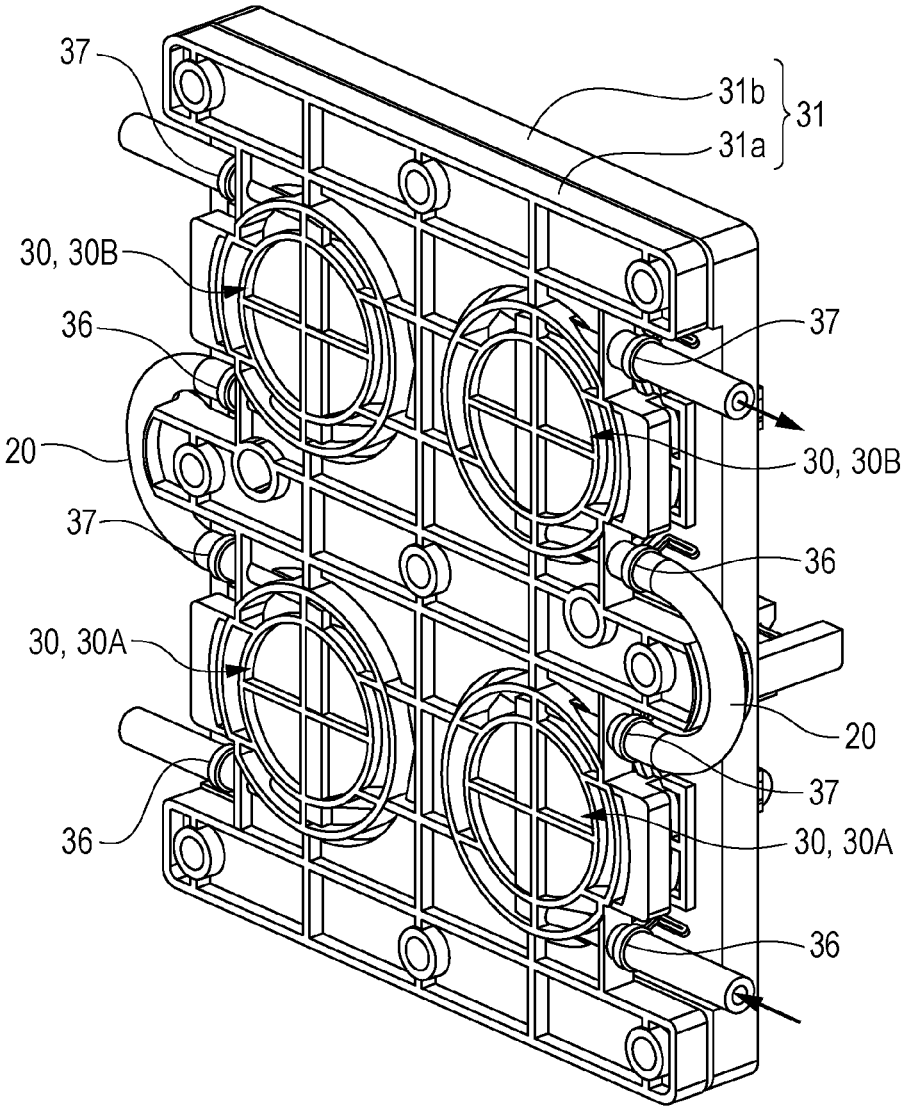
FIG. 4 is a rear perspective view of the sub-tank according to the embodiment of the invention.
Figure 5:
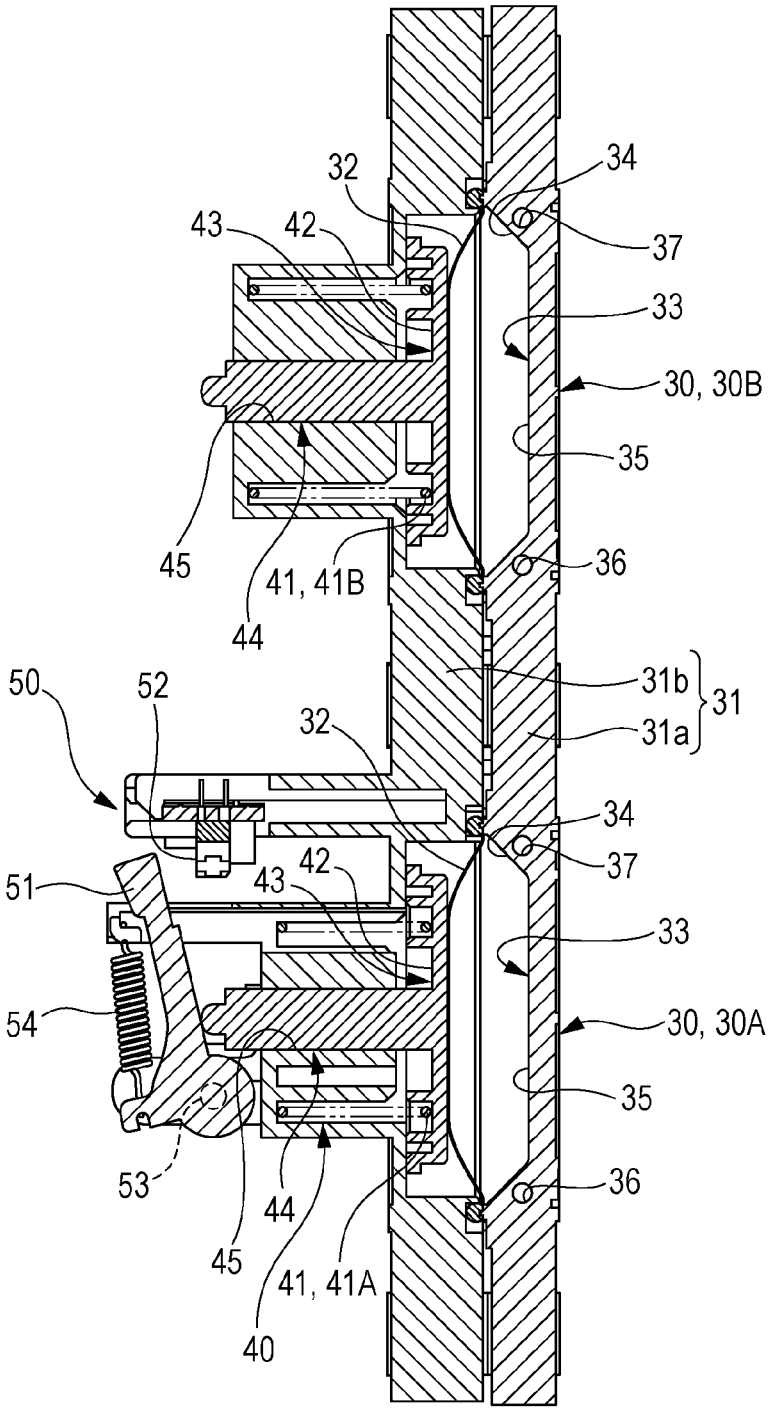
FIG. 5 is a sectional view taken along line V-V indicated by arrows in FIG. 3.
Figure 6:
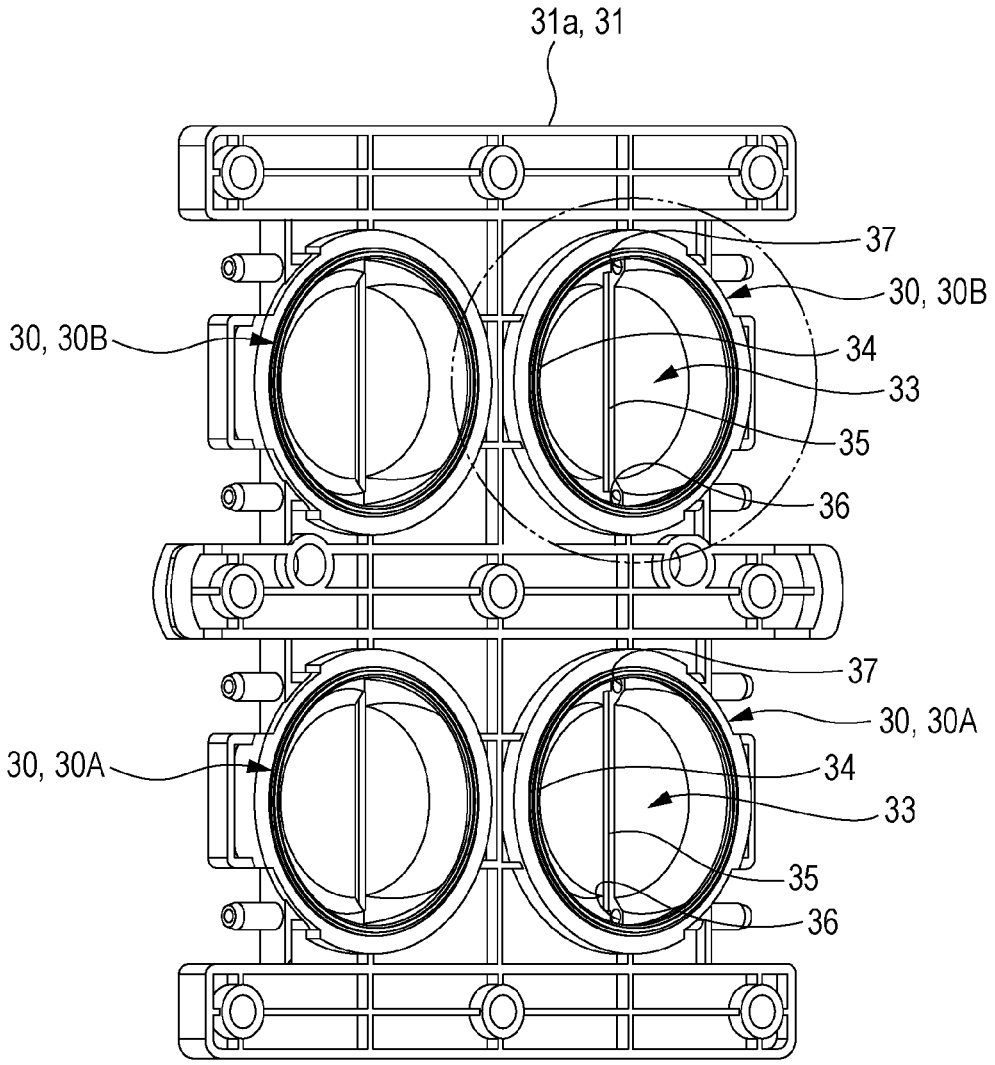
FIG. 6 is a perspective view illustrating the inside of the sub-tank according to the embodiment of the invention.
Figure 7:
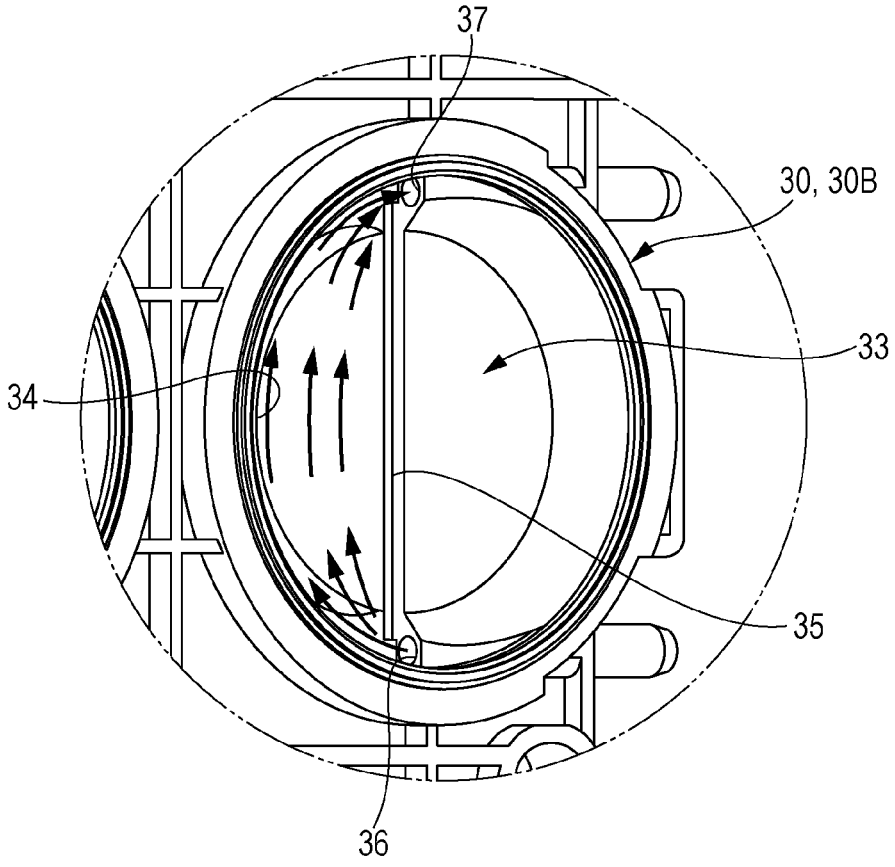
FIG. 7 is an enlarged perspective view illustrating the inside of the sub-tank according to the embodiment of the invention.

FIG. 3 is a front perspective view of the sub-tank 30 according to the embodiment of the invention. FIG. 4 is a rear perspective view of the sub-tank 30 according to the embodiment of the invention. FIG. 5 is a cross-sectional view taken along line V-V indicated by arrows in FIG. 3. FIG. 6 is a perspective view illustrating the inside of the sub-tank 30 according to the embodiment of the invention. FIG. 7 is an enlarged perspective view illustrating the inside of the sub-tank 30 according to the embodiment of the invention.

As illustrated in FIG. 3, the multiple sub-tanks 30 according to the present embodiment are unitized and are integrally provided. According to the present embodiment, two sets of the first sub-tank 30A and the second sub-tank 30B are provided in one housing 31. That is, not only the first sub-tank 30A and the second sub-tank 30B that are provided in the ink supply passage 20 described above, but also the first sub-tank 30A and the second sub-tank 30*b* that are provided in a different ink supply passage 20 are provided in the housing 31. In this manner, the unitizing of multiple sub-tanks 30 can contribute to a reduction in the number of components or the cost.

The housing 31 is formed by combining a first plate 31*a* and a second plate 31*b*. As illustrated in FIG. 5, the ink compartment 33, and an inlet port 36 and an outlet port 37, through which ink is introduced and discharged into and from the ink compartment 33, are formed in the first plate 31*a*. On the other hand, a pressurization unit 40 and a displacement sensor 50, which are described below, are provided in the second plate 31*b*. As illustrated in FIG. 6, when the second plate 31*b* and the flexible member 32 are detached, the ink compartment 33 is exposed. The ink compartment 33 has an internal wall 34 in the form of a circle. As illustrated in FIG. 5, which is a cross-sectional view, the internal wall 34 takes the shape of a bottom-truncated letter "V" (the shape of a cone) that is open to the second plate 31*b* side.

A groove portion 35 is provided in the ink compartment 33. The groove portion 35, as illustrated in FIG. 6, is formed in the upward and downward directions with respect to the center portion of the ink compartment 33. The groove portion 35 is a region that is formed deep into the first plate 31*a*, and the inlet port 36 and the outlet port 37 for ink are formed in this region. Because with the groove portion 35, the channel is secured between the inlet port 36 and the outlet port 37 for ink, although the flexible member 32 is depressed to a bottom dead point, the ink supply passage 20 is not closed.

As illustrated in FIG. 7, the inlet port 36 is provided under the sub-tank 30. The inlet port 36 is open in the direction tangential to the internal wall 34 in the shape of a circle. On the other hand, the outlet port 37 is provided over the sub-tank 30. The outlet port 37 is open in the direction tangential to the internal wall 34 in the shape of a circle. Furthermore, the inlet port 36 and the outlet port 37 are open horizontally in the same direction. With this arrangement, ink that is introduced in the direction tangential to the internal wall 34 from the lower portion of the sub-tank 30 rotates around the internal wall 34 and is discharged from the upper portion of the sub-tank 30 through the outlet port 37. For this reason, sedimentary components of ink that precipitate in the lower portion of the sub-tank 30 can be agitated and the extent to which air bubbles accumulated in the upper portion of the sub-tank 30 are discharged can be improved.

Furthermore, as illustrated in FIG. 4, the multiple sub-tanks 30, starting with the sub-tank that is positioned furthest upstream and ending with the sub-tank that is positioned furthest downstream, are arranged in order in portions of the ink supply passage 20, starting with the lowermost portion and ending with the uppermost portion in the gravitational direction. According to the present embodiment, the first sub-tank 30A on the upstream side is positioned in the lower portion of the ink supply passage 20, and the second sub-tank 30B on the downstream side is positioned in the upper portion. The ink supply passage 20 in the shape of approximately a letter "U" connects between the outlet port 37 in the first sub-tank 30A and the inlet port 36 in the second sub-tank 30B. That is, the ink supply passage 20 connects horizontally in the same direction to the outlet port 37 in the first sub-tank 30A and the inlet port 36 in the second sub-tank 30B. Accordingly, because with buoyant force, the air bubbles accumulated in the first sub-tank 30A on the upstream side can easily pass through the second sub-tank 30B on the downstream side and are easily discharged from the ink jet head H, the extent to which the air bubbles are discharged can be improved.

Referring back to FIG. 2, the printer PRT has the pressurization unit 40 that applies a different pressure to each of the flexible members 32 of the multiple sub-tanks 30. The pressurization unit 40 has multiple urging members 41 that urge the flexible members 32 of the multiple sub-tanks 30. The urging member 41 can simply adjust the pressure that is applied to each of the flexible members 32 of the multiple sub-tanks 30 by differentiating between at least ones of spring constants, strokes that displace the flexible member 32 all the way to the bottom dead point, and pressurization areas with which the flexible members 32 are pressurized.

The pressurization unit 40 according to the present embodiment has a pressure-bearing member 42 in the shape of a plate that adjusts the pressurization area with which the urging member 41 pressurizes the flexible member 32. The pressure-bearing member 42 keeps the pressurization area with respect to the comparatively-soft flexible member 32 constant. According to the present embodiment, the pressure-bearing member 42 that pressurizes the flexible member 32 of the first sub-tank 30A, and the pressure-bearing member 42 that pressurizes the flexible member 32 of the second sub-tank 30B take the same shape, and the pressurization areas are configured to be the same. As illustrated in FIG. 5, the pressure-bearing member 42 has a plate portion 43 that comes into contact with the flexible member 32, and a shaft portion 44 that is connected to the plate portion 43.

The plate portion 43 has a shape of approximately a circle, and the front side of the plate portion 43, which comes into contact with the flexible member 32, is formed on the plane. Minute concavities and convexities on which the urging member 41 sits are formed in the rear side of the plate portion 43, and the shaft portion 44 is provided on the center of the rear side. The shaft portion 44 is engaged, in a freely-sliding manner in the lengthwise direction, with a through hole 45 that pierces through the second plate 31*b*. The urging member 41 is arranged between the second plate 31*b* and the plate portion 43 of the pressure-bearing member 42, and urges the flexible member 32 in the direction of reducing the spatial capacity of the ink compartment 33.

As illustrated in FIGS. 2 and 5, because the first sub-tank 30A and the second sub-tank 30B according to the present embodiment have the same shape, the strokes that displace the flexible member 32 of the urging member 41 all the way to the bottom dead point are the same. For this reason, the pressurization unit 40 according to the present embodiment has different spring constants for the urging member 41A that pressurizes the flexible member 32 of the first sub-tank 30A and of the urging member 41B that pressurizes the flexible member 32 of the second sub-tank 30B, and is configured to apply different pressures with the same strokes and with the same pressurization areas. The spring constant of the urging member 41 can be changed by changing a material of a spring, the number of turns, or the like.

According to the present embodiment, the spring constant is adjusted in such a manner that, with the stroke all the way to the bottom dead point of the flexible member 32, the urging member 41A and the urging member 41B, for example, exert a force of 10.7 to 9.2 N (newtons) and a force of 8.3 to 7.4 N (newtons), respectively, to a sub-tank 30 that, for example, can accommodate 39 g (grams) of ink. That is, the pressurization unit 40 increases the pressure that is applied to the flexible member 32 of the first sub-tank 30A that is positioned furthest upstream, to the maximum, decreases the pressure that is applied to the flexible member 32 of the second sub-tank 30B that is positioned further downstream than the first sub-tank 30A, and decreases the pressure that is applied to the multiple sub-tanks 30, in the downstream direction.

As illustrated in FIG. 2, the displacement sensor 50 that detects the displacement of the flexible member 32 is provided in at least one among the multiple sub-tanks 30. The displacement sensor 50 may be provided in the first sub-tank 30A that is positioned furthest upstream, among the multiple sub-tanks 30. On the other hand, the displacement sensor 50 may not be provided in the second sub-tank 30B that is positioned furthest downstream. The displacement sensor 50 has a lever member 51 that moves together with the pressure-bearing member 42, and photo interrupters 52 that are provided, with a moving path for the lever member 51 being interposed between them.

The lever member 51, as illustrated in FIG. 5, is provided in a manner of freely rotating about a rotation shaft 53 with respect to the second plate 31*b*. Furthermore, a urging member 54 urges the lever member 51, and the lever member 51 maintains a state where the pressure-bearing member 42 is brought into contact with the shaft portion 44. Moreover, the spring power of the urging member 54 is sufficiently small such as to be negligible when compared with the spring power of the urging member 41. The photo interrupter 52 has a light emitting portion and a light receiving portion that are arranged with the moving path for the leading end of the lever member 51 being interposed between them, and is configured to detect the displacement of the flexible member 32 with the blocking or unblocking of an optical axis.

Subsequently, operation of the printer PRT with the configuration described above is described referring to FIGS. 8A, 8B, 9A and 9B.

FIGS. 8A, 8B, 9A and 9B are views, each illustrating a relationship over time between an amount of remaining ink within the printer PRT according to the embodiment of the invention and a pressure within the ink supply passage 20. Moreover, a numerical value, such as a pressure described below, is one example, and is suitably changed depending on a type of printing job, a type of apparatus, or the like.

In examples in FIGS. 8A, 8B, 9A and 9B, the spatial capacity of the sub-tank 30 is 3.9 g per piece, and a configuration is provided in which it is possible to accommodate a maximum of 7.8 g of ink using two sub-tanks 30. Furthermore, as described above, the spring force of the urging member 41A is set to 10.7 to 9.2 N, and the spring force of the urging member 41B is set to 8.3 to 7.4 N. Moreover, the spring force of the urging member 41 is set to generate an application pressure at which a predetermined amount of air bubbles accumulated in the ink supply passage 20 are released into the atmosphere through a tube that forms the ink supply passage 20, or the flexible member 32. Furthermore, the ink jet head H is configured in such a manner that a printing job can continue to be performed, by securing an ink supply pressure of 3.0 kPa (kilopascals) or more for the self-sealing valve 22.

Figure 8A:
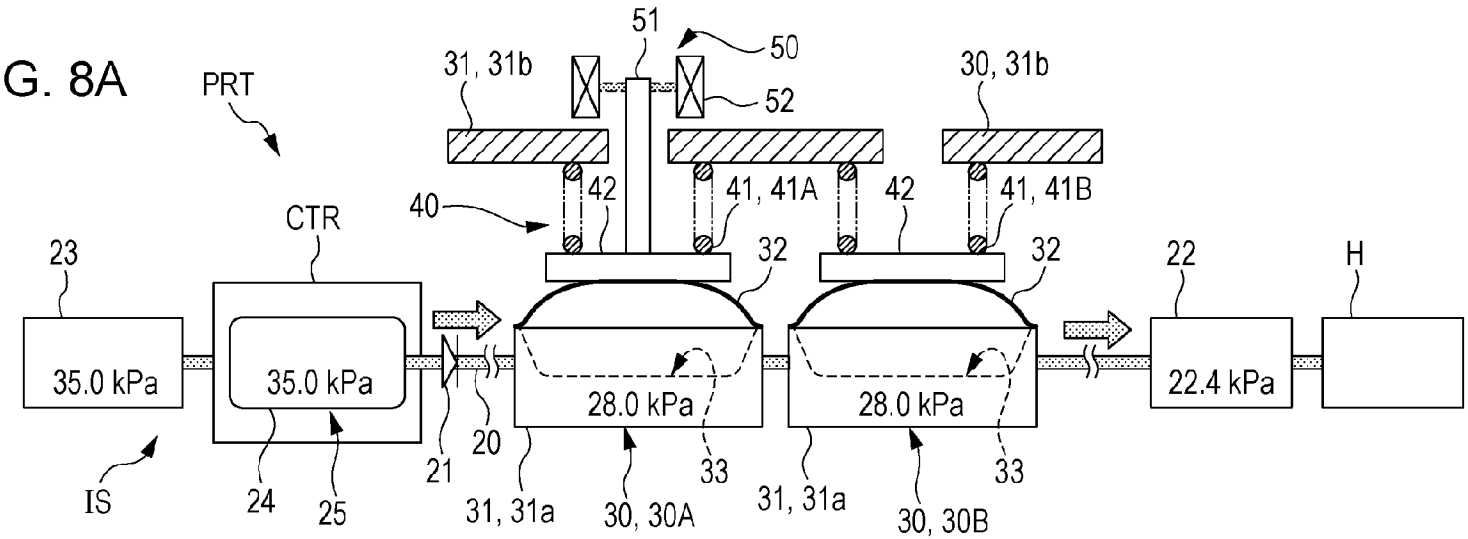
FIGS. 8A and 8B are views illustrating a relationship over time between an amount of remaining ink in the printer according to the embodiment of the invention and the pressure within an ink supply passage.

FIG. 8A illustrates a pressure within the ink supply passage 20 at the time of normal printing. The pressurization pump 23 is driven in such a manner that the ink cartridge CTR is pressurized at a pressure of 35.0 kPa. In a case where there is sufficient ink in the ink cartridge CTR, the pressure within the ink pack 24 is 35.0 kPa, which is the same as that generated by the pressurization pump 23. When the ink pack 24 is pressurized, the ink within the ink pack 24 is supplied to the multiple sub-tanks 30 through the check valve 21. When the ink pack 24 is sufficiently pressurized, an internal capacity of each of the multiple sub-tanks 30 is also maximized.

A pressure within the first sub-tank 30A at this time is 28.0 kPa, which results from a pressure loss, and a pressure within the second sub-tank 30B is almost 28.0 kPa as well. The pressure loss has an influence on the downstream side of the ink supply passage 20, but the pressure within the ink compartment 33 is greater than the pressure applied from the pressurization unit 40, and the flexible member 32 of the first sub-tank 30A and the flexible member 32 of the second sub-tank 30B are not displaced in the direction of reducing the spatial capacity of the ink compartment 33. The ink supply pressure to the self-sealing valve 22 on the side further downstream than the multiple sub-tanks 30 is 22.4 kPa as a result of the pressure loss at this time, and a pressure of 3.0 kPa or more at which the ink jet head H can normally operate is secured.

Figure 8B:
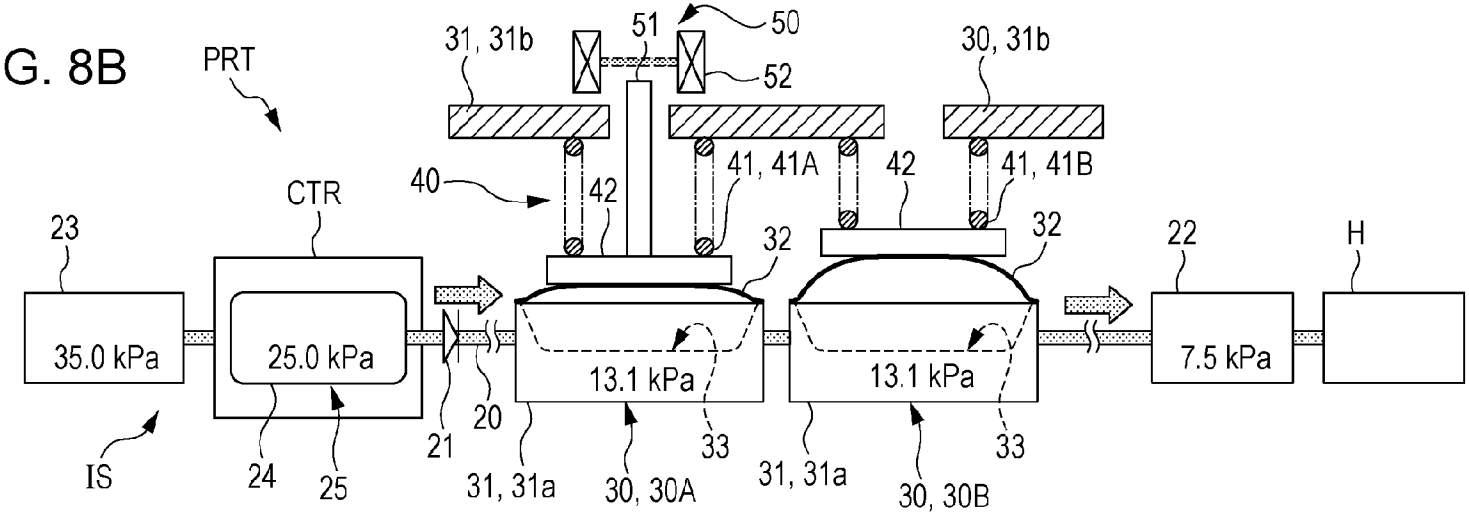

FIG. 8B illustrates the pressure within the ink supply passage 20 at the time of detecting a near ink end while the printing is in progress. When an amount of remaining ink within the ink cartridge CTR becomes low while the printing is in progress, although the pressurization pump 23 is driven at a pressure of 35.0 kPa, the pressure within the ink pack 24 does not rise up to 35.0 kPa. When the pressure within the ink pack 24 is reduced to 25.0 kPa, the pressure within each of the multiple sub-tanks 30 on the side further downstream than the ink pack 24 is reduced to 13.1 kPa at a result of the pressure loss. At this time, in the first sub-tank 30A, the pressure that is applied from the pressurization unit 40 (the urging member 41A) is greater than the pressure within the ink compartment 33, the flexible member 32 is displaced in the direction of reducing the spatial capacity of the ink compartment 33.

The displacement sensor 50 detects the near ink end when the pressure within the ink pack 24 is reduced to 25.0 kPa or less, the lever member 51 is lowered together with the flexible member 32 of the first sub-tank 30A, and the optical axis of the photo interrupter 52 is unblocked, whereby detecting the near ink end. At this time, in the other sub-tank, the second sub-tank 30B, the pressure within the ink compartment 33 is greater than the pressure that is applied from the pressurization unit 40 (the urging member 41B), and the flexible member 32 is not displaced in the direction of reducing the spatial capacity of the ink compartment 33.

Even in the near ink end is detected while the printing is in progress, the second sub-tank 30B accommodates ink necessary to complete the job that is currently performed, and provides a necessary amount of ink using the amount of remaining ink. For example, by using the ink (3.9 g) in the second sub-tank 30B, the printer PRT can perform solid printing on a sheet of paper of maximum printable size. When the near ink end is detected in the displacement sensor 50, a pressure within the self-sealing valve 22 is 7.5 kPa, and a pressure of 3.0 kPa or more at which the ink cartridge H can normally operate is secured. Moreover, when the near ink end is detected, the controller CONT displays a request for replacement of the ink cartridge CTR on a display unit not illustrated.

Figure 9A:
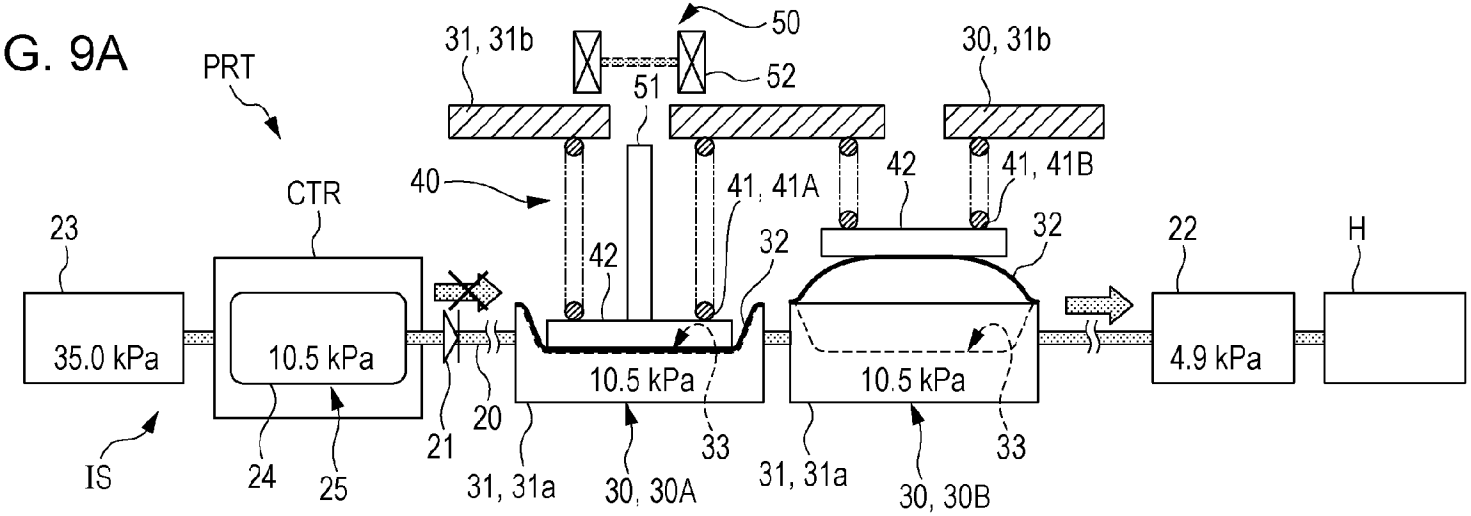
FIGS. 9A and 9B are views, each illustrating the relationship over time between the amount of remaining ink in the printer according to the embodiment of the invention and the pressure within the ink supply passage.

FIG. 9A illustrates the pressure within the ink supply passage 20 that results when the ink within the first sub-tank 30A is used up after the detection of the near ink end. When the amount of remaining ink within the ink cartridge CTR is further reduced, the pressure within the ink pack 24 is reduced to 10.5 kPa. When the pressure within the ink pack 24 is lowered, the ink does not flow to the downstream side from the ink pack 24, and the ink on the downstream side is consumed. In such a case, first, the flexible member 32 of the first sub-tank 30A to which the greatest pressure is applied by the urging member 41A with the greast is displaced up to near the bottom dead point, and almost all the ink stored in the ink compartment 33 is consumed.

Furthermore, at this time, in the second sub-tank 30B, the flexible member 32 begins to be displaced in the direction of reducing the spatial capacity of the ink compartment 33. That is, in the vicinity of the pressure at which the flexible member 32 of the first sub-tank 30A reaches the bottom dead point, in the second sub-tank 30B, the pressure that is applied from the pressurization unit 40 (the urging member 41B) is greater than the pressure within the ink compartment 33, and the flexible member 32 is displaced in the direction of reducing the spatial capacity of the ink compartment 33. The pressure within the first sub-tank 30A at this time is 10.5 kPa, and the pressure within the second sub-tank 30B is almost 10.5 kPa as well. The pressure within the self-sealing valve 22 is 4.9 kPa as a result of the pressure loss at this time, and a pressure of 3.0 kPa or more at which the ink jet head H can normally operate is secured.

Figure 9B:
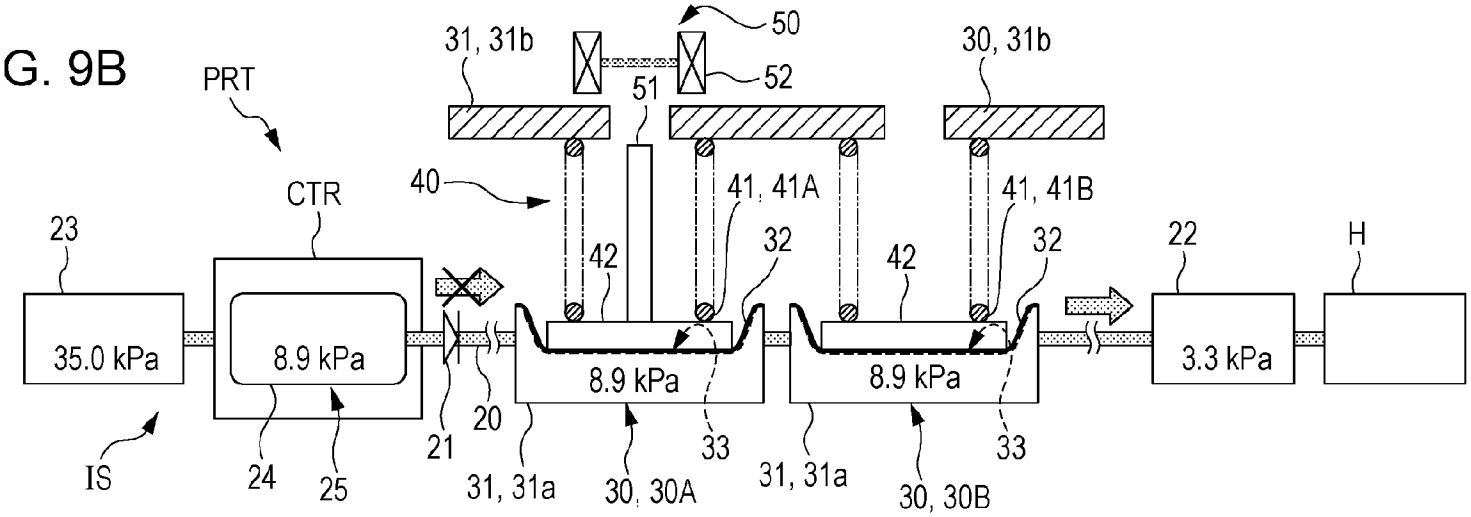

FIG. 9B illustrates a pressure within the ink supply passage 20 at the time of the ink within the second sub-tank 30B having been used up. When the flexible member 32 is displaced up to the bottom dead point, the pressure within the second sub-tank 30B is 8.9 kPa. Furthermore, the pressure within the first sub-tank 30A is almost 8.9 kPa as well, and the pressure within the ink pack 24 is almost equal to 8.9 kPa as well. At this time, the pressure in the self-sealing valve 22 is 3.3 kPa as a result of the pressure loss, and a pressure of 3.0 kPa or more at which the ink jet head H can normally operate normally is secured. That is, in the urging member 41, the application pressure exerted by the urging member 41B, which has the smallest application force, is greater than the pressure necessary for the ink jet head H to eject the ink. Therefore, even if the amount of remaining ink within the ink cartridge CTR is low, because the ink can be ejected, by the pressure that is applied to the second sub-tank 30B, from the ink jet head H, it is possible to stably supply ink until ink within the ink supply passage 20 is used up.

As described above, according to the present embodiment, the pressurization unit 40 is provided, and a different pressure is applied to each of the flexible members 32 of the multiple sub-tanks 30. In this manner, by actively applying a pressure from the outside to the flexible members 32 of the multiple sub-tanks 30, an influence of deformation characteristics of the flexible member 32 is decreased, and the multiple sub-tanks 30 can be deformed at different times. That is, according to the present embodiment, because a response of the flexible member 32 that is deformed according to the pressure is caused by the high-precision urging member 41 (spring), variationa in displacements of the multiple sub-tanks 30 can be suppressed. Therefore, a change over time in a pressure state within the ink supply passage 20 can be reliably observed, and timing for the replacement of the ink cartridge CTR can be suitably recognized from the detection of the near ink end.

Furthermore, according to the present embodiment, the pressure-bearing member 42 in the shape a plate is provided, and the pressurization area with which the urging member 41 pressurizes the flexible member 32 is adjusted. Because the application area of the urging member 41 with respect to the flexible member 32 can be kept constant by providing the pressure-bearing member 42 in the shape of a plate, the influence of the deformation characteristics of the flexible member 32 is decreased, and the multiple sub-tanks 30 can be reliably deformed at different times.

Furthermore, according to the present embodiment, by adjusting the spring constant of the urging member 41, the pressurization unit 40 applies a different pressure to each of the flexible members 32 of the multiple sub-tanks 30. That is, the application of different pressures is achieved without changing the stroke or the pressuirzation area of the flexible member 32, all of the multiple sub-tanks 30 may have the same configuration, component diversion is also possible, and contribution to cost reduction can be achieved.

Furthermore, according to the present embodiment, the pressurization unit 40 increases the pressure that is applied to the flexible member 32 of the first sub-tank 30A that is positioned furthest upstream, among the multiple sub-tanks 30, to the maximum, and decreases the pressure that is applied to the flexible member 32 of the second sub-tank 30B that is positioned further downstream than the first sub-tank 30A, in the downstream direction. With this configuration, because the multiple sub-tanks 30 are deformed at different times, starting with the sub-tank on the upstream side, a change over time in a state of the pressure within the ink supply passage 20 can be observed more reliably, and the timing for the replacement of the cartridge CTR can be recognized. Furthermore, because among the multiple sub-tanks 30, the second sub-tank 30B that is positioned furthest downstream is displaced last, as the ink end is approached, the pressure loss that results when the ink is ejected from the ink jet head H can be minimized.

Furthermore, according to the present embodiment, the displacement sensor 50 is provided in the first sub-tank 30A on the furthest upstream side among the multiple sub-tanks 30, and the displacement of the flexible member 32 is detected. Because the order in which the multiple sub-tanks 30 are deformed can be recognized by the pressure adjustment by the pressurization unit 40, if one displacement sensor 50 is provided, the change over time in the state of the pressure within the ink supply passage 20 can be observed. Furthermore, because the first sub-tank 30A on the furthest upstream side among the multiple sub-tanks 30 is nearest the ink cartridge CTR and responsiveness to the amount of remaining ink is highest, the amount of remaining ink within the ink cartridge CTR can be detected with high precision. Furthermore, after the detection of the displacement of the first sub-tank 30A, a job that is currently being performed can be continued using the ink stored in the second sub-tank 30B on the downstream side, which has a small pressure loss.

Furthermore, according to the present embodiment, the check valve 21 that allows only flowing of ink that is destined for the downstream side is provided in the ink supply passage 20 on the side further upstream than the multiple sub-tanks 30, and the self-sealing valve 22, which opens the ink supply passage 20 when the downstream side is under predetermined negative pressure, is provided in the ink supply passage 20 on the side further downstream than the multiple sub-tanks 30. With this configuration, even when the job is continued using the ink stored in the multiple sub-tanks 30 with the pressurization by the urging member 41, a reverse flow of ink to the ink cartridge CTR can be prevented by the check valve 21, and ink leakage from the ink jet head H can be reliably prevented by the self-sealing valve 22.

In this manner, according to the present embodiment described above, the printer PRT that can suppress the variation in the displacement of the sub-tank 30 and can prevent a job from being interrupted due to running out of ink is obtained by employing a configuration in which the ink jet head H that ejects ink that is supplied from the ink cartridge CTR which accommodates the ink, the ink supply passage 20 that connects between the ink cartridge CTR and the ink jet head H, the multiple sub-tanks 30, each of which has a spatial capacity, which changes, for storing the ink within the ink supply passage 20 and for storing the ink with the displacement of the flexible member 32, and the pressurization unit 40 that applies a different pressure to each of the flexible members 32 of the multiple sub-tanks 30 are included.

Subsequently, operation (printing immediately after power is supplied) during the application of the pressure to the ink cartridge CTR after the printer PRT with the configuration described above is powered on is described.

Figure 10:
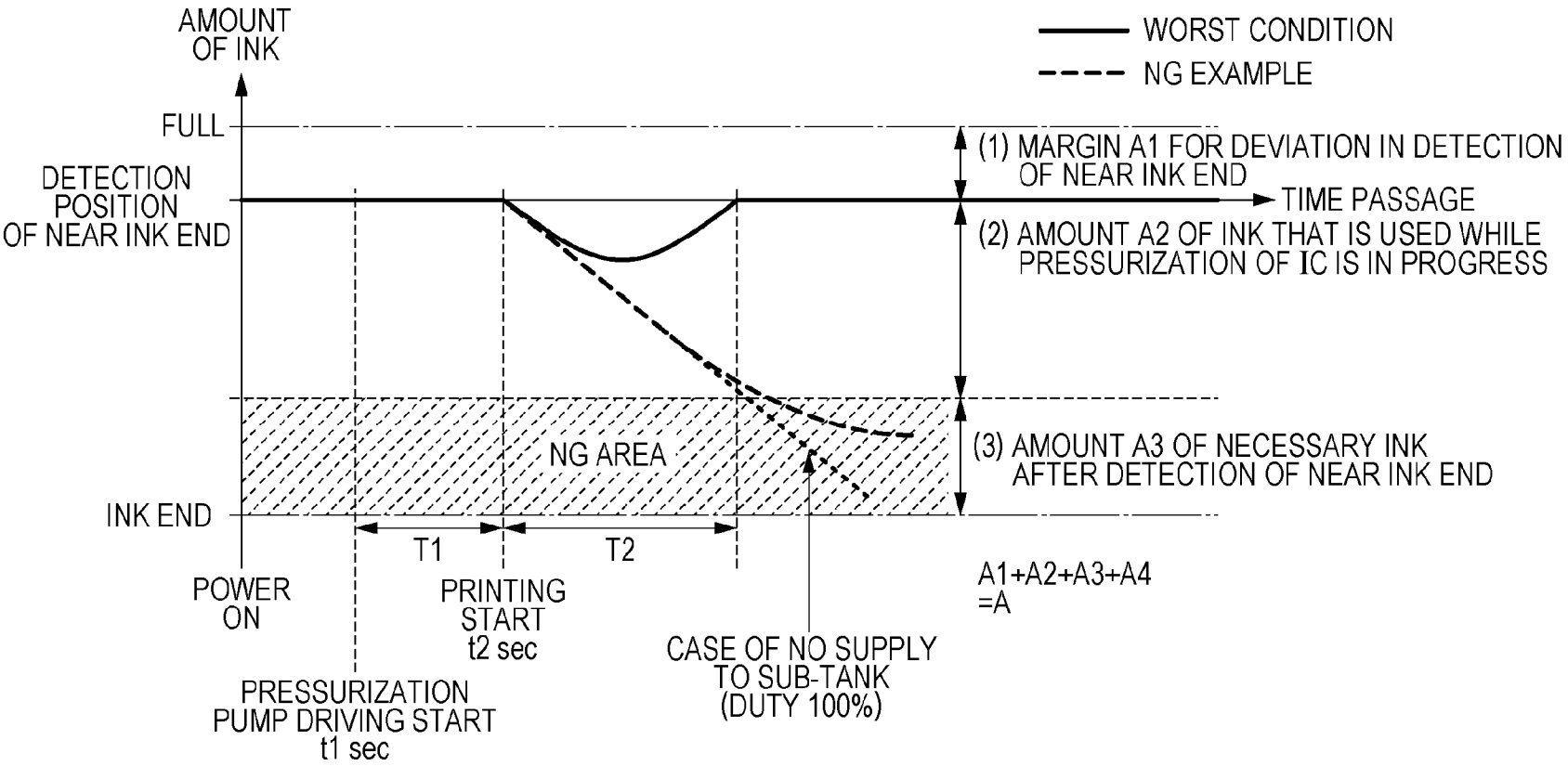
FIG. 10 is a conceptual diagram illustrating a change in an amount of ink within the sub-tank that takes place when printing is performed immediately after power is supplied, according to the embodiment of the invention.

FIG. 10 is a conceptual diagram illustrating a change in an amount of ink within the sub-tank 30 that takes place when the printing is performed immediately after the power is supplied, according to the embodiment of the invention.

In the order that after the power is supplied, during a rise period of time during which a pressure exerted by the pressurization pump 23 increases to a predetermined pressure (P[kPa]), the ink is able to be ejected from the ink jet head H, the printer PRT according to the present embodiment configures the spatial capacity of the sub-tank 30 as follows. Moreover, the worst condition that is illustrated in FIG. 10 means that the printer PRT is powered off in a state that occurs immediately before the displacement sensor 50 detects the near ink end and in this state, the printing starts immediately after the power is supplied.

As illustrated in FIG. 10, when the printer PRT is powered on, the power is supplied to each constituent device (an electric system is initialized). t1 [sec.] after the power is applied, the pressurization pump 23 starts to be driven. Then, when there is sufficient ink within the ink cartridge CTR is sufficient, T1 [sec] (t2 [sec.] after the power is supplied) after the pressurization pump 23 starts to be driven, it is possible to eject the ink from the ink jet head H. However, according to the present embodiment, in the worst condition (immediately before the detection of the near ink end), further T2 [sec.] that is the pressurization time is needed until P[kPa] is reached. In the worst condition, this is because when compared with full time, an initial pressure condition for the sub-tank 30 is low and it takes time to apply a pressure. In such a case, it is said that the printing itself cannot be performed during T2 [sec.].

However, the printer PRT according to the present embodiment has the urging member 41 that pressurizes the sub-tank 30, and for example, although the ink is not supplied from the ink cartridge CTR, with the urging member 41, it is possible to stably supply ink until the ink within the sub-tank 30 is used up. For this reason, during T2 [sec.], with the pressurization by the urging member 41, ink can be ejected from the ink jet head H.

When an amount of flow (a maximum amount of flowing ink per unit hour, which can be ejected from the ink jet head H), when performing full duty printing is set to C[g/sec.], an amount Q1 of ink flowing from the sub-tank 30, which results from the full duty printing, is C×T2 [g]. Furthermore, when an amount of ink that is caused to flow into the sub-tank 30 during T2 [sec.] by the pressurization pump 23 is set to Q2 [g], in order for the sub-tank 30 to be under a predetermined pressure (P [kPa]) after T2 [sec.] elapses in the worst condition, there is a need for the sub-tank 30 to accommodate an amount of (Q1−Q2) [g] that is a difference between an amount of outgoing ink and an amount of incoming ink, as an amount A2 of ink that is to be used while the pressurization of the ink cartridge CTR is in progress (an amount of ink used during the I/C pressurization). Therefore, A2 is set in such a manner that a relationship expressed by A2≥(Q1−Q2) is established.

When the sub-tank 30 is again not in a full state after T2 [sec.] elapses (when ink is not present in the ink cartridge CTR), as illustrated in FIG. 10, an amount of ink within the sub-tank 30 is reduced to an amount of ink indicated by an NG area (NG examples include a case where the supply to the sub-tank 30 is not in progress and a case where the supply to the sub-tank 30 is in progress, but recovery is delayed). The NG area indicates an amount A3 [g] of ink that is necessary until a job that is currently executed is terminated after the displacement sensor 50 detects the near ink end (an amount A3 [g] of ink that is necessary after the detection of the near ink end). A3 [g], for example, is an amount with which the printer PRT can perform the solid printing on a sheet of paper of maximum printable size in the full duty printing manner. Moreover, the amount of ink that is necessary after the near ink end is detected may be set to be an amount of ink with which the ink jet head H is cleaned. Furthermore, the spatial capacity A/2 [g] per one sub-tank 30 may be set to be equal to A3 [g].

Furthermore, for the spatial capacity of the sub-tank 30, a variation margin is also necessary for the displacement sensor 50 to detect the near ink end (refer to FIGS. 8B and 10). The margin for variation in the detection of the near ink end is A1 [g].

Additionally, for the spatial capacity of the sub-tank 30, margins other than the one described above are also necessary. The other margins include an amount of ink within the vicinity of the bottom dead point of the flexible member 32 that results from the groove portion 35 in the sub-tank 30 (an amount of ink that can be supplied). One of the other margins is A4 [g].

Therefore, the spatial capacity in the sub-tank 30 is A [g] that is a sum of the variation margin A1 [g] for the detection of the near ink end, the amount A2 [g] of ink that is used during the I/C pressurization, the amount A3 [g] of ink that is necessary after the detection of the near ink end, and the other margin A4 [g]. That is, a relation expressed by A=A1+A2+A3+A4 is established.

As described above, the sub-tank 30 according to the present embodiment has a spatial capacity for at least accommodating an amount of ink that results from integrating a lead-up time that the pressure exerted by the pressurization pump 23 takes to rise to a predetermined pressure over a maximum amount of flowing ink per unit hour that can be ejected by the ink jet head H. Therefore, until the pressure exerted by the pressurization pump 23 rises (for T2 [sec.] that is the time for which the pressurization pump 23 is driven after the initialization of the ink jet head H is completed) after it is possible to eject ink from the ink jet head H, it is possible to continue to eject the ink from the ink jet head H. Furthermore, because the sub-tank 30 according to the present embodiment has the spatial capacity that is the amount A3 [g] of ink or more that is necessary after the detection of the near ink end, even when the sub-tank 30 is again not in the full state, a job that is currently executed can be terminated without running out of ink midway.

Furthermore, according to the present embodiment, the urging member 41 is provided, and applies a pressure in the direction of reducing the spatial capacity of the sub-tank 30 at least for the lead-up time for the pressurization pump 23. Accordingly, an ink supply pressure sufficient for continuing to eject ink from the ink jet head H for the lead-up time for the pressurization pump 23 is secured, and it is possible to eject the ink from the ink jet head H. Therefore, according to the present embodiment, high-speed printing can be performed immediately after the power is supplied without the need to wait the lead-up time for the pressurization pump 23.

Specifically, when the pressure exerted by the urging member 41 is set to Ps, the pressure within the ink cartridge CTR, which is generated by the pressurization pump 23, is set to Pi, the pressure necessary for the ink jet head H to eject ink is set to Ph, the pressure loss within the ink supply passage 20 between the ink cartridge CTR and the sub-tank 30 is set to ΔPis, the pressure loss within the ink supply passage 20 between the sub-tank 30 and the ink jet head H is set to ΔPsh, a relationship expressed by $(Pi-\Delta Pis)>Ps>(Ph+\Delta Psh)$ is established. When the pressure exerted by the urging member 41 is greater than a sum of the pressure necessary for the ink jet head H to eject the ink and the pressure loss occurring in the ink supply passage 20 on the side further downstream than the sub-tank 30, although the pressurization pump 23 does not rise, the sufficient ink supply pressure to the ink jet head H can be secured. Furthermore, when the pressure exerted by the urging member is smaller than a difference between the pressure within the ink cartridge CTR, which is generated by the pressurization pump 23 and the pressure loss that occurs in the ink supply passage 20 on the side further upsteam than the sub-tank 30, ink that flows from the upstream side of the ink supply passage 20 to the downstream side can be used without the urging member 41 preventing the pressurization pump 23 from supplying the ink. Furthermore, the ink within the ink cartridge CTR can be used up, and it is possible to reduce an amount of remaining ink (refer to FIGS. 8A, 8B, 9A and 9B).

Furthermore, according to the present embodiment, the displacement sensor 50 is provided, and, by detecting the displacement of the spatial capacity of the sub-tank 30, the amount of remaining ink within the ink cartridge CTR can be easily recognized. Furthermore, it is easy to determine to what extent printing or cleaning is possible after the detection of the near ink end of the sub-tank 30.

Furthermore, according to the present embodiment, the displacement sensor 50 is provided in the first sub-tank 30A on the furthest upstream side among the multiple sub-tanks 30 that are arranged side by side in series, and detects the displacement of the first sub-tank 30A that has high responsiveness to an amount of remaining ink that is nearest the ink cartridge CTR. Accordingly, the amount of remaining ink within the ink cartridge CTR can be detected with high precision, and after the detection, a job that is currently being executed can be continued using ink that is stored in the second sub-tank 30B on the downstream side, which has a small pressure loss.

In this manner, according to the present embodiment described above, the printer PRT that can perform high-speed printing immediately after the power is supplied, by employing a configuration in which the ink jet head H that ejects ink that is supplied from the ink cartridge CTR which accommodates the ink, the ink supply passage 20 that connects between the ink cartridge CTR and the ink jet head H, the pressurization pump 23 that pressurizes the ink supply passage 20, the sub-tank 30 that stores ink within the ink supply passage 20, and the check valve 21 that allows only flowing of ink toward the downstream side within the ink supply passage 20 on the side further upstream than the sub-tank 30 are included and in which the sub-tank 30 has the urging member 41 that has the spatial capacity for at least accommodating an amount of liquid that results from integrating a maximum amount of flowing ink per unit hour, which can be ejected by the ink jet head H, over at least a part of the time that it takes for the ink supply passage 20 to reach a predetermined pressure with the pressure exerted by the pressurization pump 23, pressurizes the sub-tank 30 in the direction of reducing the spatial capacity for at least one portion of the time, and causes ink to be able to be ejected from the ink jet head H.

The suitable embodiment of the invention is described above referring to the drawings, but the invention is not limited to the embodiment described above. All forms and combinations of constituent members illustrated according to the embodiment described above are only examples, and it is possible to make various modifications based on design requirements within the scope that does not depart from the gist of the invention.

For example, according to the embodiment described above, the configuration in which two the sub-tanks 30 are provided is described, but a configuration in which three or more sub-tanks 30 are provided may be employed.

Furthermore, for example, according to the embodiment described above, the configuration is described in which by adjusting the spring constant of the urging member 41, the pressurization unit 40 applies a different pressure to each of the flexible members 32 of the multiple sub-tanks 30, but a configuration may be employed in which the stroke that displaces the urging member 41 displace the flexible member 32 all the way to the bottom dead point or the pressurization area with which the urging member 41 pressurizes the flexible member 32 is adjusted.

Furthermore, for example, according to the embodiment described above, the configuration is described in which a different pressure is applied to each of the flexible members 32 of the multiple sub-tanks 30 using the urging member 41 such as a spring or a rubber member, but a configuration may be employed in which another member that can apply a pressure from the outside substitutes for the urging member 41. For example, a configuration may be employed in which a pressurization pump is separately provided to apply a pressure.

Furthermore, for example, according to the embodiment described above, the configuration is described in which the displacement sensor 50 is provided only in the first sub-tank 30A. However, a configuration may be employed in which the displacement sensor 50 is provided in the second sub-tank 30B, and a configuration may be employed in which the displacement sensor 50 is provided in both of the first sub-tank 30A and the second sub-tank 30B.

Furthermore, for example, according to the embodiment described above, the configuration is described in which the sub-tank 30 is pressurized using a spring member as the urging member 41, but a configuration may be employed in which another member that can apply a pressure from the outside substitutes for the spring member. For example, a configuration may be employed in which a pressure is applied using a rubber member.

Furthermore, for example, according to the embodiment described above, the configuration is described in which the displacement sensor 50 is provided in the first sub-tank 30A that is positioned furthest upstream among the multiple sub-tanks 30 that are arranged side by side in series. However, the multiple sub-tanks 30 may be provided in parallel in the ink supply passage 20, and the displacement sensor 50 may be provided in parallel in any one among the multiple sub-tanks 30. Even with this configuration, an amount of remaining ink within the ink cartridge CTR can be recognized without any problem. Furthermore, by arranging the multiple sub-tanks 30 in parallel, the pressure loss within the channel between the sub-tanks 30, which occurs in the in-series arrangement, can be made not to occur.

Furthermore, the liquid ejecting apparatus according to the embodiment, which is described above, may be a thermal jet printer, and may be a line ink jet printer. Furthermore, the liquid ejecting apparatus is not limited to a printer, and may be an apparatus such as a copying machine and a facsimile.

Furthermore, for the liquid ejecting apparatus, a configuration may be employed in which a liquid other than ink is ejected or is dispensed. For example, it is possible to apply the invention to various liquid ejecting apparatuses, each of which includes a liquid ejecting head or the like that dispenses a very small amount of liquid as droplets. In addition, a droplet refers to a drop of liquid in a state of being dispensed from the liquid ejecting apparatus, and has shapes including a granular shape, a tear shape, and a thread shape, each of which has a tail. Furthermore, if the liquid here is a material that can be ejected by the liquid ejecting apparatus, this may be sufficient. For example, if a substance is in a state of being in a liquid phase, this may be sufficient. Substances include substances in a fluid state, such as a high or low viscosity fluid substance, a sol, an aqueous gel, other inorganic solvents, an organic solvent, a solution, a fluid resin, and a fluid metal (a metallic melt). The substances include not only liquids as a subtance in one state, but also substances that result from particles of a functional material, made from solids such as pigments and metal particles, being dissolved, distributed, or mixed with a solvent. Furthermore, for example, the ink according to the embodiment, which is described above, is enumerated as a typical example of a liquid. The ink here is defined as including general water-based ink, oil-based ink, and various liquid compositions such as gel ink and hot melt ink.

The entire disclosure of Japanese Patent Application No. 2014-216238, filed Oct. 23, 2014 and Japanese Patent Application No. 2014-218051, filed Oct. 27, 2014 are expressly incorporated by reference herein.

What is claimed is:

1. A liquid ejecting apparatus comprising:

a liquid ejecting head that ejects a liquid which is supplied from a liquid accommodation body that accommodates the liquid;

a liquid supply passage that connects between the liquid accommodation body, and the liquid ejecting head;

multiple sub-tanks, each of which stores the liquid within the ink supply passage and changes spatial capacity for storing the liquid by a displacement of a flexible member; and a pressurization mechanism that applies a different pressure to each of flexible members of the multiple sub-tanks.

2. The liquid ejecting apparatus according to claim 1, wherein the pressurization mechanism includes multiple urging members that urge the flexible members of the multiple sub-tanks, respectively and wherein the multiple urging members differ in at least one among a spring constant, a stroke that displaces the flexible member to a buttom deadcenter, and a pressurization area with which the flexible member is pressurized.

3. The liquid ejecting apparatus according to claim 2, wherein the pressurization mechanism has a pressure receiving member in the shape of a plate that adjusts the pressurization area with which the urging member pressurizes the flexible member.

4. The liquid ejecting apparatus according to claim 1, wherein the pressurization mechanism applies a maximum pressure to a flexible member of a sub-tank that is positioned furthest upstream, among the multiple sub-tanks, and decreases a pressure that is applied to a flexible member of a sub-tank that is positioned further downstream than the sub-tank, toward the downstream direction.

5. The liquid ejecting apparatus according to claim 1, wherein a displacement sensor that detects displacement of the flexible member is provided in at least one among the multiple sub-tanks.

6. The liquid ejecting apparatus according to claim 5, wherein, among the multiple sub-tanks, the displacement sensor is provided in the sub-tank that is positioned at least furthest upstream.

7. The liquid ejecting apparatus according to claim 1, wherein an inlet port through which the liquid is introduced, and the inlet port is provided in a lower portion of each of the multiple sub-tanks, and an outlet port through which the liquid is discharged, and the outlet port is provided in an upper portion of each of the multiple sub-tanks, and wherein the inlet port and the outlet port are open horizontally in the same direction.

8. The liquid ejecting apparatus according to claim 1, wherein the multiple sub-tanks, starting with a sub-tank that is positioned furthest upstream and ending with a sub-tank that is positioned furthest downstream, are arranged in order in portions of the ink supply passage, starting with the lowermost portion and ending with the uppermost portion in the gravitational direction.

9. The liquid ejecting apparatus according to claim 1, wherein a one-way valve that allows only flowing of liquid toward the downstream side is provided in the liquid supply passage on the side further upstream than the multiple sub-tanks, and wherein a pressure regulating valve that opens the liquid supply passage when the downstream side is under predetermined negative pressure is provided in the liquid supply passage on the side further downstream than the multiple sub-tanks.

10. The liquid ejecting apparatus according to claim 1, further comprising:

a pressurization unit that pressurizes the liquid accommodation body.

11. The liquid ejecting apparatus according to claim 1, wherein, among pressures that the pressurization mechanism applies, the smallest pressure is greater than a supply pressure necessary for the liquid ejecting head to eject the liquid.

12. A liquid ejecting apparatus comprising:

a liquid ejecting head that ejects liquid that is supplied from a liquid-accommodation body that accommodate the liquid;

a liquid supply passage that connects between the liquid accommodation body and the liquid ejection head;

a pressurization device that pressurizes the liquid supply passage;

a sub-tank that stores the liquid within the liquid supply passage; and a one-way valve that allows only flowing of liquid toward the downstream side within the liquid supply passage on the upstream side further upstream than the sub-tank, wherein the sub-tank includes a urging member which has spatial capacity for at least accommodating an amount of liquid that results from integrating a maximum amount of flowing liquid per unit hour, which is able to be ejected by the liquid ejecting head, over at least a part of the time that it takes for the liquid supply passage to reach a predetermined pressure by virtue of a pressure exerted by the pressurization device, pressurizes the sub-tank in the direction of reducing the spatial capacity for the at least a part of the time, and causes the liquid to be able to be ejected from the liquid ejecting head.

13. The liquid ejecting apparatus according to claim 12, wherein, when a pressure exerted by the urging member is set to Ps, a pressure within the liquid accommodation body, which is generated by the pressurization device is set to Pi, a pressure necessary for the liquid ejecting head to eject the liquid is set to Ph, a pressure loss within the liquid supply passage between the liquid accommodation body and the sub-tank is set to $\Delta Pis$, and a pressure loss within the liquid supply passage between the sub-tank and the liquid ejecting head is set to $\Delta Psh$, a relationship expressed by $(Pi-\Delta Pis)>Ps>(Ph+\Delta Psh)$ is established.

14. The liquid ejecting apparatus according to claim 12, wherein a displacement sensor that detects displacement of the spatial capacity is provided in the sub-tank.

15. The liquid ejecting apparatus according to claim 12, wherein the multiple sub-tanks are provided in series in the liquid supply passage, and wherein the displacement sensor is provided in a sub-tank that is furthest upstream, among the multiple sub-tanks.

16. The liquid ejecting apparatus according to claim 12, wherein the multiple sub-tanks are provided in parallel in the liquid supply passage, and wherein the displacement sensor is provided in any one among the multiple sub-tanks.

* * * * *